United States Patent [19]

Angelini

[11] 3,974,042

[45] Aug. 10, 1976

[54] METHOD AND APPARATUS FOR ELECTROPLATING

[75] Inventor: Sergio Angelini, Milan, Italy

[73] Assignee: Brevetti Elettrogalvanici Superfiniture, Eschen, Liechtenstein

[22] Filed: Apr. 9, 1975

[21] Appl. No.: 566,219

[30] Foreign Application Priority Data

Apr. 27, 1974 Switzerland ..... 5805/74

[52] U.S. Cl. ..... 204/25; 204/26; 204/224 R

[51] Int. Cl.[2] ..... C25D 5/02

[58] Field of Search ..... 204/26, 224 R, 25

[56] References Cited

UNITED STATES PATENTS

| | | | |
|---|---|---|---|
| 1,771,680 | 7/1930 | Ishisaka | 204/224 R |
| 1,805,215 | 5/1931 | Hammond | 204/224 R |
| 2,859,157 | 11/1958 | Curtiss, Jr. | 204/26 |
| 3,673,073 | 6/1972 | Tobey et al. | 204/26 |
| 3,751,344 | 8/1973 | Angelini | 204/26 |

*Primary Examiner*—T. M. Tufariello
*Attorney, Agent, or Firm*—Fidelman, Wolffe & Waldron

[57] ABSTRACT

A method and apparatus for electroplating elongated metal pieces, such as bars, pipes, cylinders, according to which an electroplating bath is provided between an electrode and the surface opposite thereto of the piece to be plated; the electrode and associated electroplating bath are moved along the surface of the piece to be plated, while replenishing the electroplating liquid.

18 Claims, 7 Drawing Figures

METHOD AND APPARATUS FOR ELECTROPLATING

This invention relates to a method for electro-deposition or generally electroplating metal pieces, such as internal and/or external chromium plating in pipes, bars, cylinders and the like.

The present invention is also concerned with an apparatus for carrying out the method according to the invention.

It has been hitherto proposed, for example, to internally chromium plate the pipes by placing along the pipe axis an anode extending throughout the pipe length, which is then filled up with an electrolytic bath.

Therefore, the anode has to be centered beforehand and secured internally of the tube with a considerable waste of time and labour. In addition to this, the methods hitherto known involve the use of large amounts of electrolyte with a resulting high current consumption and heat loss. It is also known to chromium plate large cylinders or rollers of high weight and size, such as press rams or paper mill rollers, the weight of which may range between 5 and 400 quintals and more, by dipping the same in an electroplating tank of a large volume. Such a method involves the use of large amounts of electrolyte and high current intensities which can easily reach even a rate of 100,000 amp. and more. In turn, high amperages involve the use of large supply equipments and substantial losses weighing heavily on the system efficiency. Additionally, frequent problems are encountered in the prior art methods when dipping pieces of a considerable size in the chromium plating bath; chromium plating rate is low with a generally uneven deposit of metal because of the undue distance and length of the anode relative to the piece to be chromium plated.

It is the object of the present invention to provide a method for electroplating metal pieces also of considerable size and weight, allowing to operate with a highly reduced amount of electrolytic solution as a result of a lower heat dispersion and reduced current consumption.

It is a further object of the present invention to provide a method and apparatus of the above character, allowing to operate with a considerably reduced current intensity over the conventional systems, this enabling to use electric supply equipments of a reduced size, further reducing or minimizing the losses. It would suffice to consider that with an apparatus according to the invention, it would be possible to operate with current rates in the order of a few thousands of amperes in opposition to current rates of several tens of thousands amperes in conventional systems, and this to appreciate the importance or weight of the invention.

It is another object of the invention to provide a method and apparatus of the specified character, allowing, as a result of the greater proximity of the anode to the surface of the piece to be electroplated, a higher plating rate, firmer anchoring and technical electroplating characteristics outstanding those of the conventional method. For instance, where chromium plating is concerned, also the second grinding is dispensed with, since the thickness of the metal deposit is uniform throughout the surface of metal piece. The basic principle, on which the method and apparatus according to the invention is grounded, consists of forming an electroplating bath between an electrode of a comparatively reduced size with respect to the piece length to be plated and the surface portion of said piece opposite said electrode, applying electroplating current between said electrode and metal piece, continually moving such an electrode with the electroplating bath along the surface of the piece to be plated, and maintaining a continuous replenishment of the electrolytic solution.

The invention will now be described with reference by mere way of example to internal chromium plating of pipes and chromium plating of the external surface of cylindrical pieces or rollers, as shown in the figures of the accompanying drawings, in which.

Figure 1:
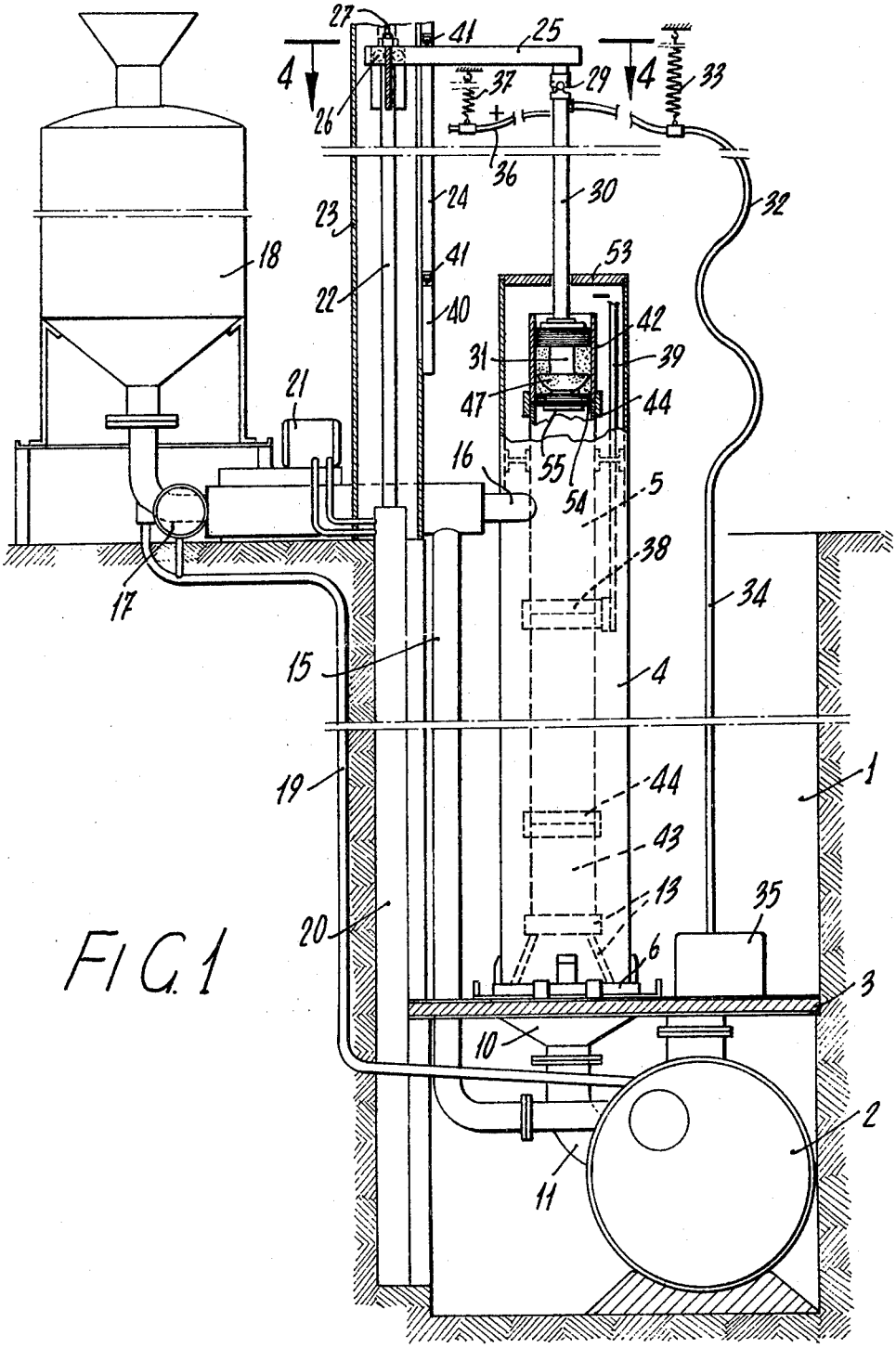
FIG. 1 is a schematic view shhowing the entire apparatus for carrying out the method according to the invention, particularly for internal chromium plating of pipes.

As shown in the general view of FIG. 1, the apparatus is partly placed in a pit 1 of the ground, on the bottom of which provision is made for a tank 2 containing a predetermined amount of electrolytic solution.

A platform or shelf 3 is provided at the tap of tank 2 and carries a closed electroplating chamber 4, comprising a tubular element of material resistant to acids, such as polyvinyl chloride or other plastics material.

This tubular element 4, defining the plating chamber wherein the piece, such as pipe 5, to be electroplated is placed, is supported by platform or shelf 3 through a centering device comprising an annular support 6, also of plastics material, bearing on a metal plate 7, having centering screws 8 for said annular support 6 arranged along its edge.

Similarly to the supporting disc 6, said plate 7 has a central passage 9 which through a coupling 10 is connected to a pipe 11, in turn connected to said tank 2 for gravity return of the electrolytic solution falling internally or externally of pipe 5 to be electroplated, as it will be understood from the explanations given in the following.

At the top, the supporting disc or ring 6 has a circular seat 12, accomodating therein a supporting stool 13 or stand for pipe 5 to be electroplated. This pipe supporting stool 13 also has a central aperture, through which the electrolyte can fall from inside said pipe 5.

Tank 2 and electroplating chamber 4 are also connected through pipings 15 and 16, respectively, to an exhaust fan continuously removing the electrolyte gases or vapours, conveying the same to a scrubber 18 where such gases or vapours are condensed and recovered and then returned to tank 2 through a piping 19.

Laterally of electroplating chamber 4 there is a double acting cylinder 20, or other equivalent means, which is mostly located in said pit 1 and connected through delivery and return pipings to an oleodynamic control station 21, as schematically shown in FIG. 1.

The maximum stroke for the piston of the double acting cylinder 20 is equal to or higher than the maximum length of the pieces to be electroplated and carried a stem 22 vertically sliding within a guide box 23, on one side the latter having a longitudinal aperture 24, through which a horizontal arm 25 extends and is slidable therealong.

In order to prevent turnings or distortions of stem 22 of said double acting cylinder, in its vertical stroke this stem is guided by pairs of opposing rollers or bearings 26 carried by a crosspiece 27 fast with stem 22 and sliding along vertical guides 28 comprising Tees which are welded or directly secured internally of said box 23. It is apparent that stem 22 could be guided also in a manner other than that above specified.

Arm 25 fast with stem 22 of the double acting cylinder 20 carries through an articulated joint 29, such as a universal joint (FIG. 1), a longitudinally bored vertical rod 30, at its lower end having the plating electrode 31, schematically shown in FIG. 1, but particularly shown in the sectional view of FIG. 2 described hereinafter. Still in FIG. 1, it will be seen that this bored rod 30 accomplishes a dual function, particularly that of supplying the electrolytic solution internally of pipe 5 to be electroplated, and supplying the electric current to said electrode 31.

To this end, the upper end of rod 30 is connected through a flexible tube or hose 32, supported for example by a spring 33, and a rigid piping 34, to a pump 35 drawing in said tank 2.

Similarly, a conducting cable 36 is connected to the upper end of the electrolyte supply rod 30 for the positive pole of the electric power supply to electrode 31, this cable 36 being also supported by a spring 37, the other electrode or cathode comprising said pipe 5 which is connected by means of metal collars 38 (only one of which shown in FIG. 1) and a conducting rod 39 to the negative pole of the electric power supply, not shown in the drawings.

Still in FIG. 1, it will be seen that externally and longitudinally of the guide box 23 for said stem 22 of the double acting cylinder 20 there is a metric rod 40 along which electric limit switches 41 are arranged for controlling the station 21 and which may be displaced and differently positioned in dependance on the length of tube or piece 5 to be electroplated.

Figure 2:
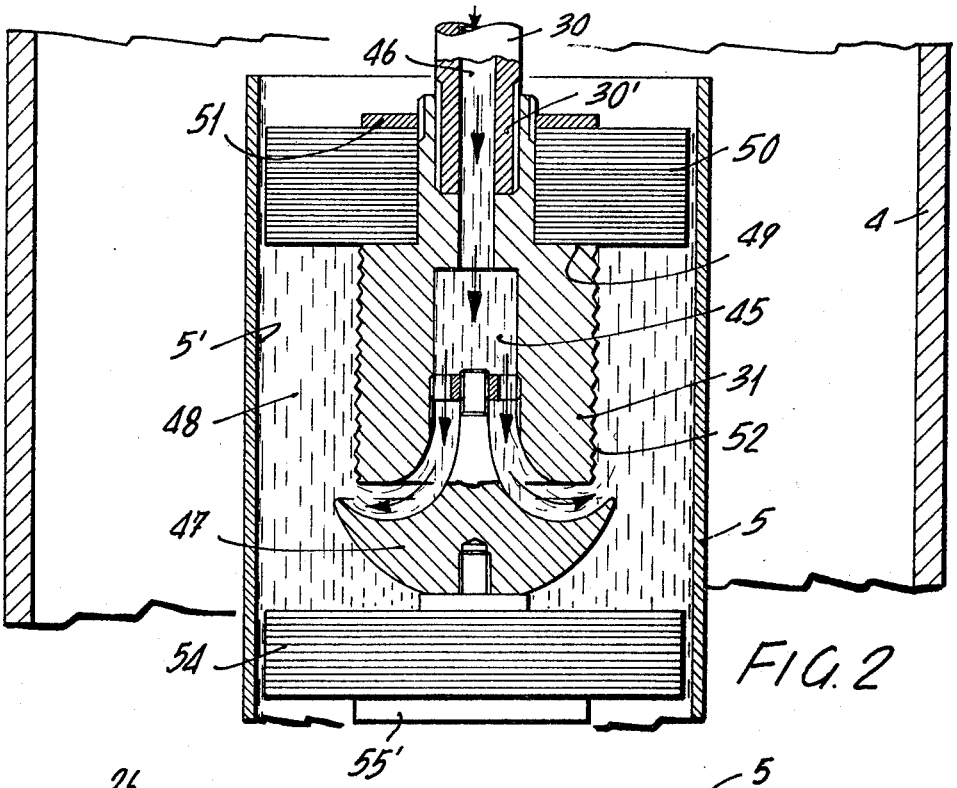
FIG. 2 is an enlarged sectional view taken along a vertical plane at the anode internally of the pipe to be plated.
Figure 4:
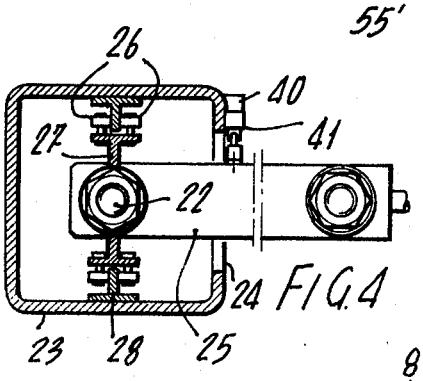
FIG. 4 is an enlarged cross-sectional view taken along line 4—4 of FIG. 1.
Figure 3:
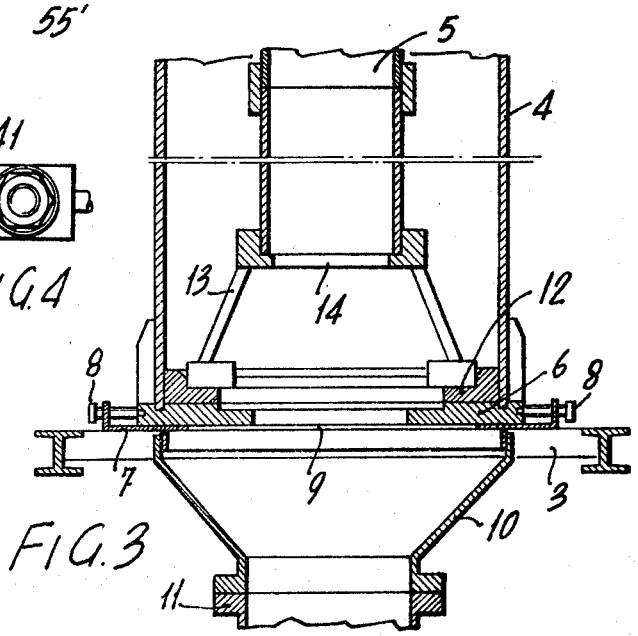
FIG. 3 is an enlarged sectional view taken along a vertical plane at the bottom tube mounting.

For internally electroplating the entire pipe 5, as shown in FIG. 2, at the end of the latter extensions 42 and 43 are placed, these extensions being previously secured by means of sleeves 44, wherein extensions 42 have an inner diameter equal to the inner diameter of pipe 5 to be electroplated.

Referring to FIG. 2, a detailed description will be given for a particular construction of electrode 31 allowing to carry out the electroplating method according to the invention.

As shown in FIG. 2, electrode 31 has a cylindrical body of lead, silver or other insoluble material, having an external diameter less than the inner diameter of pipe 5 to be electroplated, and axially extending for a short portion of the pipe length. The electrode body 31 is axially bored, as shown at 45, and at its upper end has an internally threaded counterhole, wherein the threaded lower end 30' of the electrolyte supply rod 30 is screwed, the hole 46 of rod 30 communicating with the hole 45 of anode 31.

At the bottom, electrode 31 also carries a lock nut 47, also made of insoluble material, which is substantially of a mushroom shape to define together with the lower end of electrode 31 a circular shifting passage of the electrolyte radially outwardly directed or against the inner wall 5' of pipe 5. Therefore, an annular space 48 is defined between electrode 31, lock nut 47 and the surface portion opposite the inner wall 5' of pipe 5 to be electroplated, forming therein an electroplating bath of reduced size and substantially equal to the electrode length.

At the top, the body of electrode 31 may have a shoulder 49 with discs 50 of antiacid fabric, or other material to make up a top closure for the electroplating bath, bearing thereon. These discs 50 have an external diameter equal to or slightly less than the inner diameter of the tubular element 5 and are held in place by a threaded ring or nut 51 screwed down on the electrode 31. Further rings 54 are secured through a screw 55 to lock nut 47 for defining a lower closure for the electroplating bath.

Therefore, during apparatus operation, the electrolyte will completely fill up the annular space 48 defined between the outer surface of electrode 31 and the portion of opposite inner surface of pipe 5, at which plating material can be carried out. Any electrolyte upward overflowing by seeping between the closure rings 50 and the pipe wall, or downward dropping, will fall into chamber 4 surrounding pipe 5 and therefrom return to tank 2. In the embodiment shown, wherein provision is made for closure discs 40 and 54 both at the top and at the bottom of the electrode, the electrolyte is supplied through a continuous replenishment at a comparatively low pressure of about 1.5–2 atmospheres. Otherwise, in the absence of lower closure discs 54, or should the electrode be differently formed with transverse outlet passages of the electrolyte, the latter must be supplied at a higher pressure, for example 3–4 atmospheres.

From FIG. 2 it will be also seen that the outer surface of electrode 31 has circumferential undulations and ridges 52 serving the purpose of concentrating the plating current flows or streams to the confronting inner surface of pipe 5. Therefore, it is apparent that at any time, electroplating of the pipe surface will occur always and only at the electroplating bath formed between electrode 31 and the portion of opposite surface of metal pipe, while the remainder of the pipe will remain substantially empty. Thus, a substantial reduction is obtained in the required amount of electrolyte, while continuously maintaining a replenishment of fresh electrolyte.

Moreover, the movement of the electroplating bath together with electrode 31, as explained in the following, facilitates the removal of hydrogen bubbles which, otherwise, could stop or adhere to the inner surface of the pipe to be electroplated.

Now the operation of the apparatus shown according to the method of the invention will be described.

After placing pipe 5 to be electroplated with the extensions 42 and 43 secured by means of sleeves 44, pipe 5 so pre-arranged is vertically placed within plating chamber 4. By bearing on stool 13, pipe 5 remains automatically centered in place.

After placing pipe 5 in the plating chamber 4, double acting cylinder 20 is operated to lower electrode 31, which previously was at lifted position, until introducing it into the upper end of the pipe or its extension 42, as schematically shown in FIG. 1. Chamber 4 is then closed by means of a cover or lid 53.

Once electrode 31 has been placed in the pipe, being correctly aligned with the axis of the latter due to the provision of joint 29 at the upper end of electrode supporting rod 30, pump 35 is operated to draw the electrolytic solution from tank 2, continuously and at some pressure supplying it through pipings 32 and 34 and bored or hollow rod 30 to electrode 31. On emerging from electrode 31, the solution is deviated against the inner surface of the pipe and fills up the annular space between the outer surface of electrode 31 and the portion of the opposing inner surface of pipe 5. Thus, an electroplating bath is built up at this zone and therefore is substantially restricted to the length only of electrode 31. The electrolyte, downward falling or dropping or possibly overflowing from the pipe top, will fall into the plating chamber 4 and therefrom will return by gravity to tank 2.

Now, should current be applied and at the same time should cylinder 15 be operated, the electroplating process would be started with electrode 31 and electroplating bath 48 moving along the inner surface of pipe 5 to be plated.

Upon electrode 31 and electroplating bath 48 reaching the lower end of the pipe, the limit switch provides for reversing the control or drive to the double acting cylinder 20, whereby electrode 31 and electroplating bath 48 are upwards moved. The reciprocation of electrode 31 and electroplating bath 48 may be continued for two or three times until the desired plating thickness is achieved. Upon completion of pipe electroplating, the pump is stopped, the electrode is unthreaded from the pipe and the latter removed from the electroplating chamber 4 and replaced by another pipe to be electroplated. During the operation of the apparatus, the exhaust fan 17 is of course operating and provides for removing the vapours from tank 2 and plating chamber 4 to scrubber 18.

Figure 5:
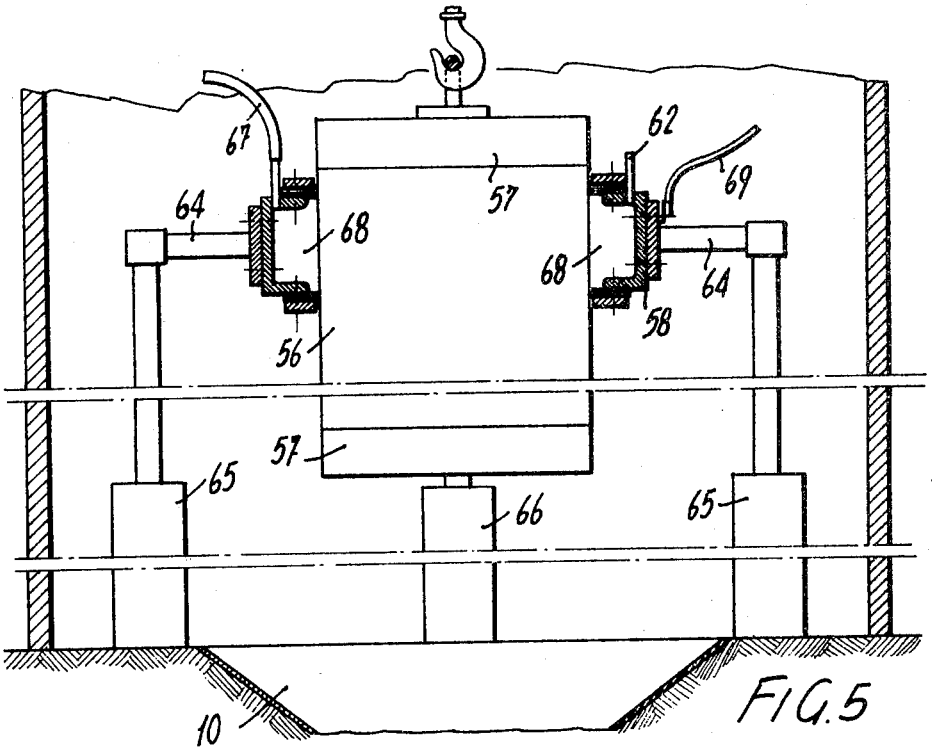
FIG. 5 is a schematic view showing a modified embodiment of the apparatus for plating the external surface of pipes, bars, large cylinders and pistons or rams.
Figure 7:
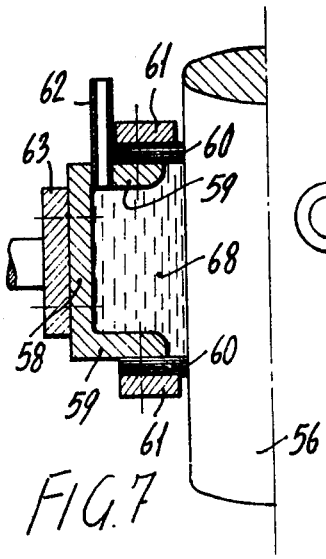
FIG. 7 is an enlarged partial view of the electrode.
Figure 6:
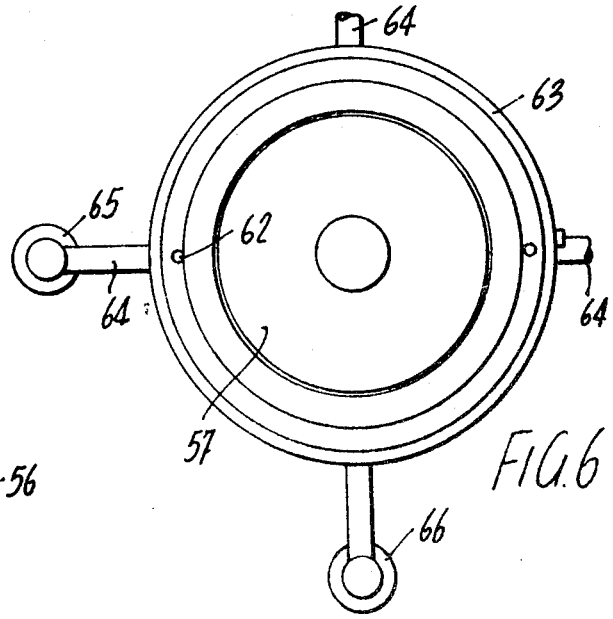
FIG. 6 is a top plan view of the apparatus shown in FIG. 5.

Referring now to FIGS. 5, 6 and 7, a variant or modified embodiment will be described of the apparatus for plating the outer surface of metal pieces having a substantially constant cross-section, still using the principal in accordance with the present invention. In FIGS. 5, 6 and 7 the apparatus has been schematically and fragmentarily shown omitting, for the sake of simplicity in representation some parts, such as for example the suction and scrubbing system, which however should be always provided as in the preceding case. In the figures, a roller preheating furnace was also omitted.

Referring to FIG. 5, it will be seen that a large roller 56, which for example is held at suspended position and the outer surface of which had to be plated, for example electroplated, has always end extensions 57 applied thereto, the outer diameter of these extensions exactly corresponding to the outer diameter of the roller to be electroplated.

Roller 56 is surrounded or enclosed by a hollow circular electrode 58, made of lead or other insoluble material, having at its ends inwardly facing circular flanges 59, as more clearly shown in the enlarged detail of FIG. 7. The inner diameter of electrode 58, that is to say of its circular flanges 59, is larger than the diameter or dimensions of the outer surface of the roller or metal piece to be electroplated. Therefore, also in this case means are provided for top and bottom sealing, substantially comprising discs 60 of antiacid fabric as interposed between an electrode flange 59 and an external ring 61 of polyvinyl chloride or other suitable plastics material.

Ring 61 and sealing discs 60 are secured, for example riveted to the associated flange 59 of electrode 58, andn additionally said sealing discs 60 have an inner diameter equal to or slightly larger than the diameter or roller or piece 56 to be electroplated. The electrode is also provided with a vent 62 (FIG. 7) for hydrogen.

Electrode 58 is externally surrounded or enclosed and secured, for example by riveting, to a metal steel band 63 forming a reinforcement structure.

Four arms 64, in two by two opposite arrangement, are secured, for example welded, to said metal band 63 and serve the purpose of supporting and guiding the electrode in its upward and downward vertical movement.

More particularly in the example shown, two opposite arms 64 have connected thereto the stems of two double acting hydraulic cylinders 65 driven by a suitable hydraulic station or power source (not shown), whereas the other two opposite arms slide along vertical guides 66 to prevent the electrode assembly from rotating, while allowing at the same time a movement parallel thereto. A flexible tube or hose 67 supplies electrolytic solution to bath 68, while an electric cable 69 is connected to the metal band 63 substantially similarly to the example shown in FIG. 1. An electroplating chamber surrounds the apparatus and communicates with a tank, to which the liquid is returned by gravity. The operation of the apparatus shown in FIGS. 5, 6 and 7 is substantially similar to that described for the preceding example, with the only difference that the outer surface is now plated for a metal piece, such as roller 56 shown.

Therefore, from the foregoing and as shown in the accompanying drawings it will be understood that the invention provides a novel method and apparatus for electroplating, particularly inner electroplating in pipes, the principle of which consists of providing an electroplating bath in the space between the electroplating electrode and the opposite inner surface of the piece to be electroplated and moving the electroplating bath together with the electrode along the piece.

Thus, the required amount of electrolyte is considerably reduced, a continuous replenishment of electrolyte is provided in the electroplating bath, and by moving the latter, chromium or other metallic deposits on the wall of piece are obtained, substantially free of hydrogen inclusions or defects.

What is claimed is:

1. Apparatus for electroplating the surface of a vertically disposed pipe, bar, cylinder or the like which comprises:

a plating electrolyte container;

a plating zone having an upper and a lower end;

an electrode within said zone;

means for continuously admitting electroplating electrolyte under pressure into said zone;

sealing means in close proximity with the surface at at least one end of said zone for retaining electrolyte in said zone;

the electrolyte within said zone substantially filling the same and contacting an exposed area of the surface;

said electrode being in a directly opposed or face-to-face relationship to the exposed area;

said sealing means being adapted to permit electrolyte to pass out of the plating zone;

means for conducting the passed electrolyte to the container;

means for converying electrolyte under pressure from the container to the plating zone;

means for moving said plating zone vertically along the surface; and means for supplying electric current to the electrode and said surface for causing the surface to be plated at the exposed area.

2. The apparatus of claim 1 wherein said plating zone has upper and lower sealing means in close proximity with the surface and the electrolyte passes or seeps between said sealing means and the surface.

3. The apparatus of claim 2 wherein the plating zone is located within the interior opening of a pipe or the like for electroplating the interior surface.

4. The apparatus of claim 3 wherein the plating zone comprises an electrode centrally located within the interior opening, said electrode having upper and lower end portions and a longitudinal axial bore, the upper and lower sealing means being located at end portions of the electrode, and means for supplying electrolyte through the axial bore.

5. The apparatus of claim 4 wherein the axial bore within said electrode terminates in a circumferential opening at the lower portion.

6. The apparatus of claim 5 wherein the electrode has projections on its outer surface.

7. The apparatus of claim 6 wherein the electrode has constraining means to keep it from rotational movement within said interior opening.

8. The apparatus of claim 7 wherein the vertically disposed pipe, bar, cylinder and the like and the associated plating zone and electrode means are disposed within a closed chamber, and wherein the electrolyte container and chamber are joined by pipe means to exhaust means whereby vapors are removed from the chamber, a scrubber connected to the exhaust means for condensing and recovering the vapors, and means for returning the condensed vapors to the electrolyte container.

9. The apparatus of claim 2 wherein the plating zone surrounds the outer surface of a vertically disposed metal piece having a constant cross-section for electroplating said outer surface, said metal piece being longer than the plating zone.

10. The apparatus of claim 9 wherein the metal piece has a circular cross-section, and wherein the plating zone comprises a circular electrode member having a diameter larger than the metal piece, whereby the electrode surrounds said piece, an outer reinforcing member surrounding the electrode, sealing means leading from the electrode to the metal piece to form a receptacle for electroplating electrolyte, and means for venting gases from the anode chamber.

11. The apparatus of claim 10 wherein the electrode has constaining means to keep it from rotational movement, wherein the vertically disposed metal piece is disposed within a closed chamber and wherein the electrolyte tank and chamber are joined by pipe means to exhaust means whereby vapors are removed from the second chamber, a scrubber connected to the exhaust means for condensing and recovering the vapors, and means for returning the condensed vapors to the electrolyte container.

12. A method for electroplating a surface of a metal piece comprising a vertically disposed pipe, bar, cylinder or the like which comprises:

forming a moveable electroplating zone having an electrode and an electroplating solution, said zone being adjacent the metal piece at a portion of its surface, locating the electrode directly opposite or in a face-to-face relationship with the said surface portion continuously feeding electroplating electrolyte under pressure into said electroplating zone and retaining it in the zone to permit electroplating, continuously passing the electrolyte out of said zone, contacting at least a portion of the surface with the electrolyte passing out of the zone, moving the zone vertically along said surface and supplying electric current to the electrolyte and metal piece for causing the surface portion adjacent the electroplating zone to be plated.

13. The method of claim 12 which comprises sealing the electroplating zone between the electrode and the surface to be plated at at least one end of the electrode by sealing means, and passing electrolyte between the sealilng means and the surface.

14. The method of claim 13 which comprises sealing the electroplating zone at each end of the electrode by sealing means.

15. The method of claim 14 wherein the electrolyte passing out of the electroplating zone is recycled to the electroplating zone.

16. The method of claim 15 wherein vapors formed during the electroplating are removed and condensed and then recycled to the electroplating zone.

17. The method of claim 16 wherein the electroplating zone is located within the interior surface of a pipe or the like for plating said interior surface.

18. The method of claim 16 wherein the electroplating zone surrounds the exterior surface of a metal piece of regular cross-section, said zone extending vertically a fraction of the height of said metal piece, the said electroplating completed extending over the entire exterior surface of the work piece.

* * * * *